US009070319B1

(12) United States Patent
Soni et al.

(10) Patent No.: US 9,070,319 B1
(45) Date of Patent: Jun. 30, 2015

(54) SELECTIVE TRANSFORMATION OF OVERLAPPING IMAGE OBJECTS

(75) Inventors: Sachin Soni, New Delhi (IN); Anmol Dhawan, Ghaziabad (IN); Ganesh Sahai, Noida (IN)

(73) Assignee: ADOBE SYSTEMS INCORPORATED, San Jose, CA (US)

( * ) Notice: Subject to any disclaimer, the term of this patent is extended or adjusted under 35 U.S.C. 154(b) by 2035 days.

(21) Appl. No.: 12/059,443

(22) Filed: Mar. 31, 2008

(51) Int. Cl.
*G09G 5/14* (2006.01)

(52) U.S. Cl.
CPC ..... *G09G 5/14* (2013.01)

(58) Field of Classification Search
CPC ..... G09G 5/14; G06T 15/005
USPC ..... 345/629; 715/209; 382/173
See application file for complete search history.

(56) References Cited

U.S. PATENT DOCUMENTS

| | | | | |
|---|---|---|---|---|
| 7,148,907 | B2 * | 12/2006 | Smith et al. | 345/629 |
| 7,636,097 | B1 * | 12/2009 | Holloway | 345/619 |
| 2007/0146389 | A1 * | 6/2007 | Distler | 345/629 |
| 2007/0230810 | A1 * | 10/2007 | Kanatsu | 382/173 |
| 2008/0082907 | A1 * | 4/2008 | Sorotokin et al. | 715/209 |

* cited by examiner

*Primary Examiner* — Chante Harrison
(74) *Attorney, Agent, or Firm* — Keller Jolley Preece

(57) ABSTRACT

Method, systems, and apparatus, including computer program products, for selective transformation of overlapping image objects. One method includes identifying, in a computer graphics illustration, an overlapping region formed by a region of an overlapping image object having transparency positioned over a region of an overlapped image object, wherein the overlapping image object and the overlapped image object are resolution independent image objects, combining the region of the overlapping image object and the region of the overlapped image object to form a transformed region that is resolution independent, and storing the transformed region and other regions of the computer graphics illustration, which other regions are not combined to form the transformed region to provide for further processing.

18 Claims, 4 Drawing Sheets

SELECTIVE TRANSFORMATION OF OVERLAPPING IMAGE OBJECTS

BACKGROUND

The present disclosure relates to transforming computer graphics illustrations.

Computer graphics illustrations displayed in a display device can include multiple image objects that overlap one another. Depending upon properties of the image objects and device capabilities, the computer graphics illustration can be combined to generate a transformed computer graphics illustration which is compatible with an output device. The properties of the image objects include transparency, resolution independence, and the like, while device capabilities include availability of resources for processing, storage, and the like.

One method to create and export computer graphics illustrations is to use software applications such as Adobe® Indesign® CS3 or Adobe® Illustrator® CS3 offered by Adobe Systems Incorporated of San Jose, Calif. to create the illustrations, and export the illustrations in a portable document format (PDF), such as the Adobe® PDF, where transparency is preserved. The PDF is provided to a print engine, such as Adobe® PDF Print Engine, that uses a graphics manager to combine resolution independent regions of the computer graphics illustration without requiring knowledge of final rendering conditions, and subsequently, combines resolution dependent regions of the computer graphics illustration that require knowledge of final rendering conditions. For example, the computer graphics illustration is planarized, where the graphics manager splits the illustration into atomic regions. Subsequently, only atomic regions in which only vector objects are included are combined in a process called blending flat tints. Finally, regions where raster objects are involved are rendered by the graphics manager.

SUMMARY

This specification describes technologies relating to selective transformation of overlapping image objects.

In general, in one aspect, a computer-implemented method includes receiving a computer graphics illustration including multiple image objects comprising a resolution dependent image object and a resolution independent image object, the computer graphics illustration stored in a computer-readable medium, identifying, in the computer graphics illustration, an overlapping region formed by a region of an overlapping image object having transparency positioned over a region of an overlapped image object, wherein the overlapping image object and the overlapped image object are resolution independent image objects, combining the region of the overlapping image object and the region of the overlapped image object to form a transformed region that is resolution independent, and storing the transformed region and other regions of the computer graphics illustration, which other regions are not combined to form the transformed region to provide for further processing. Other implementations of this aspect include corresponding systems, apparatus, and computer program products.

This, and other aspects, can include one or more of the following features. The storing can include transmitting the transformed region and other regions of the computer graphics illustration to a computer-readable medium to provide for further processing. The method can further include receiving the transformed region and other regions of the computer graphics illustration, and combining regions of any remaining overlapping image objects that have not been previously combined to form corresponding transformed regions upon determining that an overlapping object of the any remaining overlapping image objects has transparency. Combining the region of the overlapping image object and the region of the overlapped image object to form a transformed region that is resolution independent can be performed at a host location, and combining regions of any remaining overlapping image object that have not been previously combined to form corresponding transformed regions can be performed at a remote location. The method further can further include combining regions of any remaining overlapping image objects that have not been previously combined to form corresponding transformed regions at a raster image processor operatively coupled to the remote location. The method can further include operatively coupling the host location to the remote location via one or more networks. The method can further include displaying the computer graphics illustration in a display device. The method can further include displaying a selectable option to combine the region of the overlapping image object and the region of the overlapped image object to form the transformed region that is resolution independent, and in response to detecting a selection of the selectable option, forming the transformed region at a host location.

Particular implementations of the subject matter described in this specification can be implemented to realize one or more of the following advantages. Selectively transforming regions of overlapping image objects in a computer graphics illustration before transmitting the illustration for further processing can reduce the time required for the further processing. Further, selectively transforming regions that include resolution independent image objects can maintain the selectively transformed regions as device independent image objects. In addition, illustrations that include partially processed image objects, as described herein, can require relatively fewer resources for complete processing.

The details of one or more implementations are set forth in the accompanying drawings and the description below. Other features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
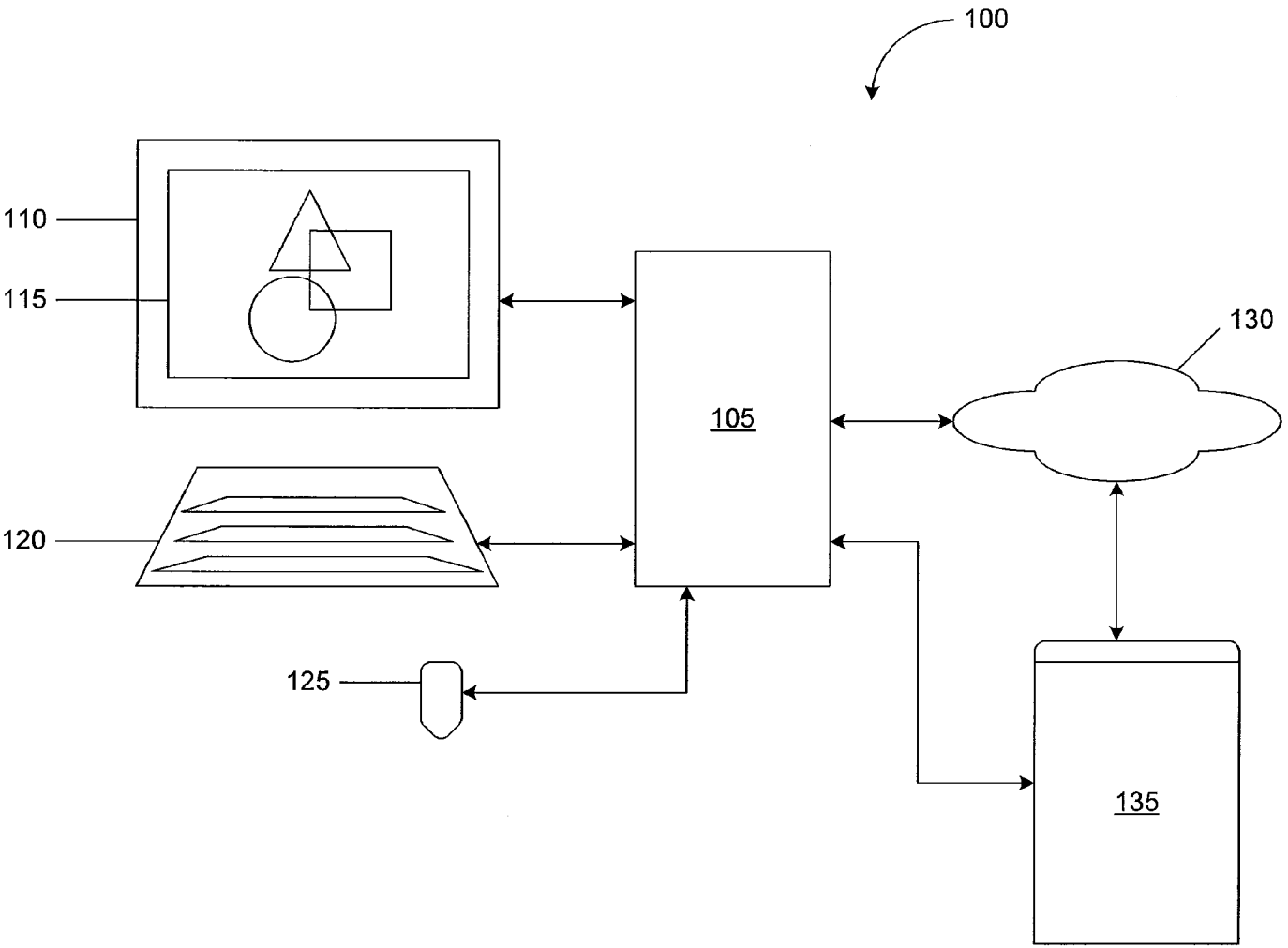
FIG. 1 is an example system for transforming overlapping image objects.

FIG. 1 is an example system 100 for transforming image objects. The system 100 is configured to selectively transform image objects included in a computer graphics illustration that can be displayed in a user interface 115 in a display device 110. The system 100 can include any computer system such as a desktop computer, a laptop computer, personal digital assistant (PDA), and the like. The system includes a computer 105 that can be operatively coupled to the display device 110 displaying the user interface 115. In addition, the system 100 can include input devices, such as a keyboard 120 and a pointing device 125, e.g., a mouse, a stylus, and the like, operatively coupled to the computer 105. A user can provide input to the computer 105 using the keyboard 120 and the pointing device 125, and can view the outcome of the input in the display device 110, e.g., in the user interface 115. Further, the computer 105 can be operatively coupled to a remote processor 135 either directly or over one or more communication networks 130.

The computer graphics illustration can be stored on a storage device operatively coupled to the computer 105, e.g., a hard disk, and can be accessed using the input devices, namely, the keyboard 120 and the pointing device 125. The computer graphics illustration includes multiple image objects that include an overlapping image object positioned over at least one overlapped image object. The image objects can include vector image objects and raster image objects. The computer 105 identifies overlapping regions formed by a region of an overlapping image object positioned over an overlapped image object. Depending upon properties of the overlapping and overlapped image object, the computer 105 can selectively combine the region of the overlapping image object and the overlapped image object to form a transformed region, and store the transformed region and other regions of the computer graphics illustration that are not combined to form the transformed region. Subsequently, the computer 105 can make available, e.g., by transmission via one or more communication networks 130, the transformed region and the other regions of the computer graphics illustration to the remote processor 135. The remote processor 135 can combine regions of any remaining overlapping objects that have not been previously combined to form corresponding transformed regions. In this manner, overlapping regions of image objects in a computer graphics illustration can be combined to form a revised computer graphics illustration.

The image objects in a computer graphics illustration include resolution dependent image objects such as raster image objects and resolution independent image objects such as vector image objects. Further, the image objects include transparent image objects and non-transparent image objects. A resolution independent image object can be transparent or non-transparent. Similarly, a resolution dependent image object can be transparent or non-transparent. The computer 105 and the remote processor 135 combine a region of the overlapping object and a region of the overlapped object if the overlapping object has transparency. The transparency of the overlapping image object indicates the extent to which an overlapped image object can be seen through the overlapping image object. In processing the computer graphics illustration, the image object's transparency is shown by the use of a technique known as blending. Blending involves combining a foreground color, associated with the overlapping image object, and a background color, associated with an overlapped image object, to create a third color to give the image object the appearance of being translucent. The foreground and background colors need not be a uniform color alone, but can include one or more patterns, where each pattern can include one or more colors. If a non-transparent image object is positioned over another transparent or non-transparent image object, then neither the computer 105 nor the remote processor 135 need perform any combining.

Combining the region of the overlapping object having transparency with the region of the overlapped object can include blending the regions. The color resulting from blending is a function of the color of the overlapping region, the color of the overlapped region, the blend mode which describes the way in which two or more colors can be combined, and the overlapping image object's opacity characteristics.

The computer 105 identifies an overlapping region formed by an overlapping image object having transparency positioned over a region of an overlapped image object. Further, the computer 105 determines that both, the overlapping image object and the overlapped image object, are resolution independent image objects, e.g., vector image objects. Upon making such determination, the computer 105 combines the region of the overlapping image object and the corresponding region of the overlapped image object to form a transformed region that is also resolution independent.

In some implementations, subsequent to combining, the computer 105 stores the transformed region and other regions of the computer graphics illustration, which other regions are not combined to form the transformed region. For example, the computer 105 can store the transformed region and other regions on a computer-readable medium, e.g., a hard disk, a CD, and the like. Subsequently, the transformed region and other regions can be transferred from a computer-readable medium to a processor, e.g., a raster image processor, for further processing. In other implementations, the computer 105 can transmit the transformed region and other regions to the remote processor 135, e.g., a raster image processor, for further processing, via one or more communication networks 130.

The remote processor 135 can combine any remaining portions of the computer graphics illustration, generate a revised computer graphics illustration, and in some implementations, provide the revised computer graphics illustration to an output device, e.g., a printer. In other implementations, subsequent to combining any remaining portions to generate a revised computer graphics illustration, the remote processor 135 can store the revised computer graphics illustration on a storage device, e.g., a hard disk. In other implementations, the remote processor 135 can transmit the revised computer graphics illustration to the computer 105 at the host end and make available the revised computer graphics illustration to a user at the host end.

In some implementations, the computer 105 is configured to receive a computer-readable medium, e.g., a CD-ROM, tangibly embodying a computer program product, e.g., code related to a software application, where the computer program product includes instructions to perform operations. For example, the computer 105 can include a CD-ROM drive to receive the CD. The CD can be a disk that includes instructions corresponding to a software application that enables transforming overlapping image objects. In other implementations, the computer 105 can download the instructions corresponding to the software application from a remote location over one or more networks, e.g., the Internet.

Figure 2:
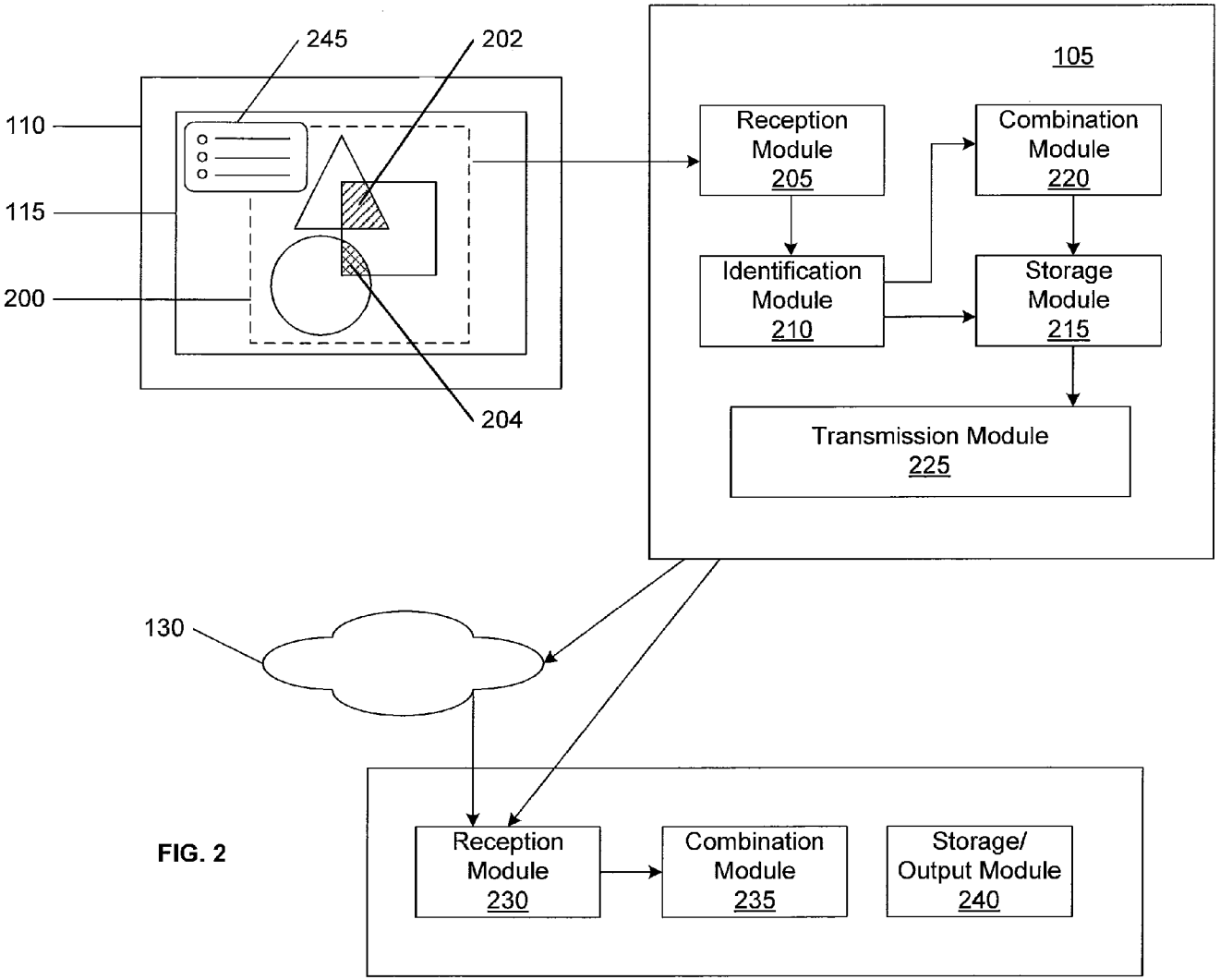
FIG. 2 is an example system for selectively transforming overlapping image objects.

FIG. 2 is an example system 100 for selectively transforming overlapping image objects. In some implementations, the system 100 includes a display device 110 displaying a computer graphics illustration 200 in a user interface 115. The illustration 200 can include two or more image objects, which can be any graphical entity, e.g., a photo, a font, or any printable feature. In addition, the image objects in the illustration 200 can include resolution independent image objects, e.g., vector image objects, resolution dependent image objects, e.g., raster image objects, or both. Further, the image objects in the illustration 200 can include transparent image objects, non-transparent image objects, or both. A raster image object can be transparent or non-transparent. Similarly, a vector image object can be transparent or non-transparent. In some implementations, a software application installed in the computer 105, to which the display device 110 is operatively coupled, can enable a user to draw image objects of the illustration 200 in the user interface 110 using one or more input devices, e.g., the keyboard 120, the pointing device 125, and the like. The user can position the image objects in a desired arrangement, e.g., one image object over another image object, to create the illustration 200.

Alternatively, the software application can enable the user to import a previously created illustration 200 which is stored on a storage device operatively coupled to the computer 105. In some implementations, the computer graphics illustration can be transmitted to the computer 105 from one or more devices operatively coupled to the computer 105 via one or more networks, e.g., network 130, and the illustration 200 can be displayed on the display device 110.

The image objects included in the illustration 200 include overlapping image objects and overlapped image objects positioned in a manner to form one or more overlapping regions, e.g., region 202 and region 204. Although the example illustration 200 includes two overlapping regions, multiple image objects of an illustration 200 can be arranged to form multiple overlapping regions, where an overlapping image object is positioned over more than one overlapped image object. The image objects in the illustration 200 can include resolution dependent and resolution independent image objects, and transparent and non-transparent objects. For example, the resolution dependent image objects can be raster image objects, e.g., photographs, and the like, meaning that the physical size of such image objects is directly associated with their resolution, e.g., the number of Dots (pixels) per Square Inch or DPI that such image objects contain. The resolution independent image objects can be vector image objects, e.g., vector graphics, made of lines and curves defined by mathematical objects, that can be scaled to any size and printed on any output device at any resolution without losing detail or clarity.

The software application installed in the computer 105 includes a reception module 205 to receive the illustration 200 from a computer-readable medium 207 on which the illustration 200 is stored. In some implementations, the computer 105 can include a hard disk on which the illustration 200 is stored. In other implementations, the computer-readable medium can be an external storage device operatively coupled to the computer 105, e.g., through wired or wireless methods and/or via one or more networks.

The software application installed in the computer 105 includes an identification module 210 to identify one or more overlapping regions, e.g., regions 202, 204, formed by a region of an overlapping image object in the illustration 200 positioned over a region of an overlapped image object. Further, the identification module 210 can identify if the overlapping image object is a transparent or non-transparent image object, and if the overlapping and overlapped image objects are resolution dependent or resolution independent image objects. The identification module 210 divides the illustration 200 into multiple atomic regions including regions 202 and 204, where each atomic region represents the smallest intersection of the image objects in the illustration 200. For example, the illustration 200 contains three image objects that form two overlapping regions, and are divided into five atomic regions. Two of the five atomic regions are overlapping regions where a region of one image object is positioned over a region of another image object. The three remaining regions are not overlapping regions. The identification module 210 can also identify if the image objects in the overlapping regions are resolution dependent or independent, and if the overlapping image object is transparent or non-transparent.

The software application installed in the computer 105 includes a combination module 220 to combine the region of the overlapping image object and the region of the overlapped image object if both the overlapping and overlapped image objects are resolution independent image objects, e.g., vector image objects, and if the overlapping image object has transparency. For example, region 202 is formed by an overlapping image object that is transparent and resolution independent, and is positioned over an overlapped image object that is also resolution independent. The combination module 220 combines the two image objects that form region 202 to form a transformed region that is also resolution independent. In region 204, the overlapping image object is resolution dependent, e.g., a raster image object. Consequently, the combination module 220 does not combine the regions that form region 204. The combination module 220 combines the two resolution independent image objects, e.g., based on the mathematical representation of the image objects that form the overlapping region. The two resolution independent image objects can be represented mathematically, e.g., by Bezier curves. The intersection of the two resolution independent image objects forms the overlapping region, and the mathematical representation of the overlapping region can be determined based on the Bezier curves of the resolution independent image objects. Further, to determine the color values at the intersection of the resolution independent image objects, e.g., to determine the color of the overlapping region, the regions of the image objects can be combined, e.g., by blending. The process of blending takes the overlapping image object and the overlapped image object, and combines them in accordance with a specified blend function to generate the transformed region. The transformed region can be considered as a final image object or treated as the overlapping or overlapped image object in a subsequent blending operation.

The software application installed in the computer 105 can include a storage module 215 to store the transformed region and other regions of the illustration 200, where the other regions are not combined to form the transformed region. The storage module 215 can be a computer-readable medium, and can be included, e.g., in the computer-readable medium 207 from which the illustration 200 was received. If the identification module 210 identifies that at least one image object of the image objects that form the overlapping regions is resolution dependent, then the combination module 220 does not combine the regions that form the overlapping region. In such cases, the identification module 210 can divide the illustration 200 into atomic regions and the storage module 215 can store the atomic regions in the computer-readable medium. Thus, the transformed region that is resolution independent, and the other regions that are not combined to form the transformed region form a device-independent representation of the illustration 200 that can be transmitted to any device for further processing.

The software application installed in the computer 105 can include a transmission module 225 to transmit the transformed region and other regions of the illustration 200 to a remote processor 135, e.g., a raster image processor, operatively coupled to the computer 105 either by wired methods or via one or more communication networks 130, for further processing. The remote processor 135 can tangibly embody a software application, e.g., in a computer-readable medium, that includes a remote reception module 230 to receive the transformed region and other regions of the illustration 200. The software application embodied in the remote processor 135 can include a remote combination module 235 to combine, e.g., by blending, any remaining overlapping image objects that have not been previously combined to form corresponding transformed regions. Prior to such combining, the remote combination module 235 can determine that an overlapping object of any of the remaining overlapping image objects has transparency. The remote processor 135 can include a remote storage/output module 240 configured to store the transformed regions of the illustration 200 as a revised computer graphics illustration.

In this manner, the operation of blending image objects in a computer graphics illustration can be divided into two parts where each part is performed on a separate device. The first part, performed by a first device, e.g., the computer 105, includes combining a foreground color of an overlapping image object having transparency with a background color of an overlapped image object where both the overlapping image object and the overlapped image object are resolution independent. The second part, performed by a second device, e.g., the remote processor 135, includes combining any remaining overlapping image objects that have not been previously combined. In some implementations, the software application installed in the computer 105 can display a control panel 245 in the user interface 110, which includes options that a user can select. The control panel can include multiple selectable radio buttons with an option displayed adjacent to each button. Alternatively, the options can be displayed in a drop down box, in a list including selectable check boxes, and the like.

The options include a choice to transform all overlapping regions at the second device. The user can select this option if at least one of the image objects in the computer graphics illustration is a resolution dependent image object, e.g., a raster image. For example, the user can select this option if the raster image object has transparency and is an overlapping image object. If the user selects this option, in response, the computer graphics illustration can be transmitted to the raster image processor for combining regions of any overlapping image objects.

The options can include a choice to combine overlapping regions including resolution independent image objects at the first device, e.g., the computer 105, and resolution dependent image objects at the second device, e.g., raster image processor. The option can be presented to a user, e.g., displayed in the user interface 115, if at least one overlapping region is formed by positioning a region of a resolution independent image object over a region of another resolution independent image object. If the user selects this option, in response, the region of the resolution independent overlapping image object and the region of the resolution independent overlapped image object can be combined at the computer 105 to form at least one transformed region. The at least one transformed region and other regions of the computer graphics illustration, which include regions that are not combined, can be transmitted to the raster image processor. The raster image processor can combine any remaining overlapping regions that have not been previously combined, where the remaining overlapping regions are formed when a region of a resolution independent image object is positioned over a region of a resolution dependent image object, or vice versa or, when a region of a resolution dependent image object is positioned over a region of another resolution dependent image object.

In some implementations, the software application installed in computer 105 can determine that all objects in the computer graphics illustration are resolution independent image objects. The software application can display a message in the user interface that informs the user that combining any overlapping region in the computer graphics illustration can be performed by the software application without requiring transmitting to a raster image processor.

Figure 3:
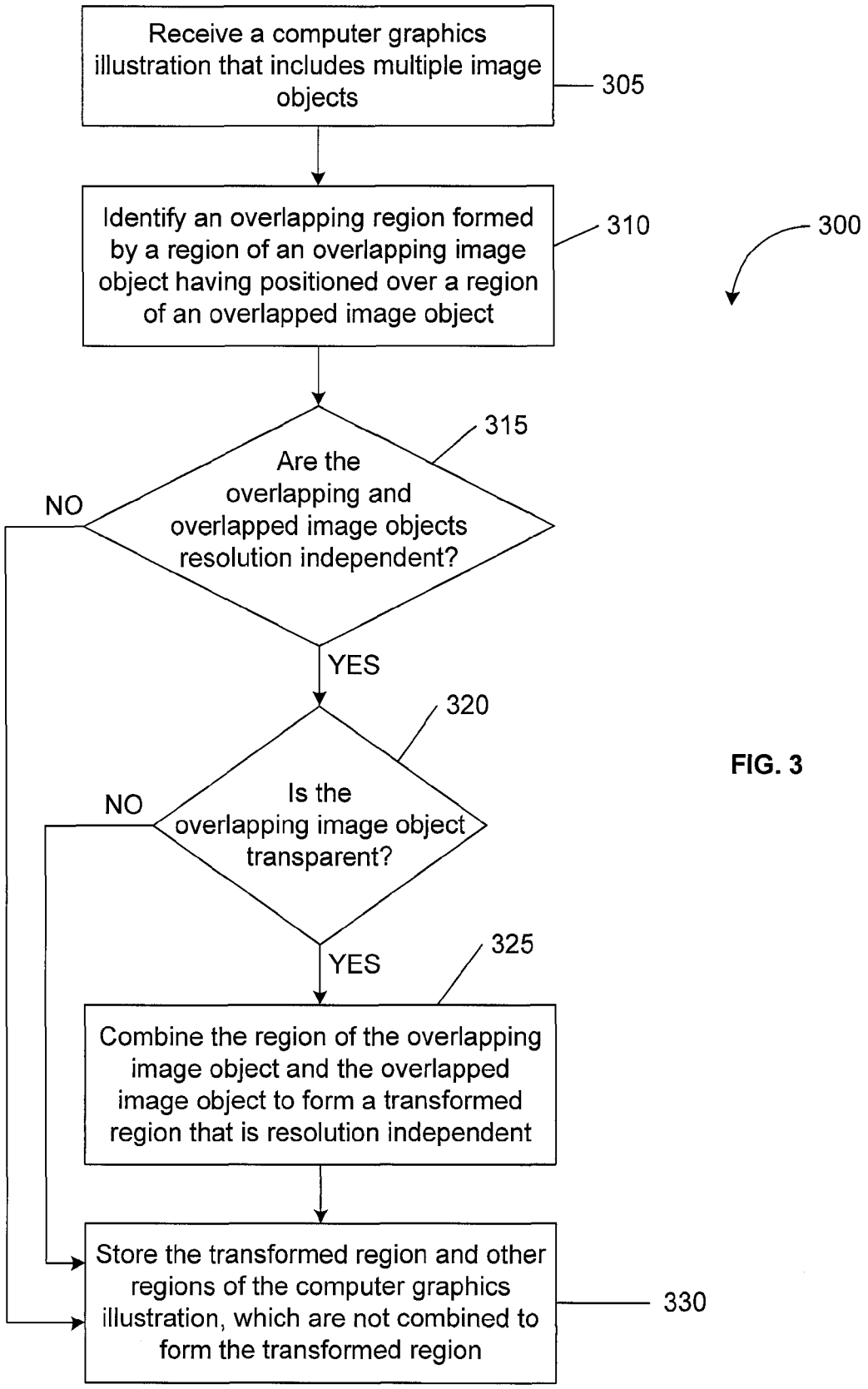
FIG. 3 is an example process for selectively transforming overlapping image objects.

FIG. 3 is an example process 300 for selectively transforming overlapping image objects. The process 300 can receive 305 a computer graphics illustration that includes multiple image objects. For example, a computer, e.g., a central computer of a computer system, can receive a computer graphics illustration that has previously been created and stored on a computer-readable medium. The computer graphics illustration can include multiple image objects that include a resolution dependent image object and a resolution independent image object.

The process 300 can identify 310 an overlapping region formed by a region of an overlapping image object positioned over a region of an overlapped image object. For example, the computer can divide the computer graphics illustration into multiple atomic regions, where each atomic region represents the smallest intersection of the image objects in the illustration.

The process 300 can check 315 if the overlapping and overlapped image objects are resolution independent. For example, the computer can determine if the overlapping and overlapped image objects are vector image objects made of lines and curves defined by mathematical objects, that can be scaled to any size and printed on any output device at any resolution without losing detail or clarity.

If both the overlapping image object and the overlapped image object are resolution independent, the process 300 can check 320 if the overlapping image object includes transparency. For example, the computer can identify atomic regions formed by the overlapping image object and the overlapped image where the overlapping image object has transparency.

If the overlapping image object has transparency, then the process 300 can combine 325 the region of the overlapping image object and the overlapped image object to form a transformed region that is resolution dependent. For example, the computer can mathematically represent the atomic region formed by the intersection of two or more resolution independent image objects. The computer can generate the mathematical representation of the overlapping region based on the Bezier curves of the image objects that form the overlapping region. Further, color values in the overlapping region can be determined by combining the regions of the resolution independent image objects, e.g., by blending.

The process 300 can store 330 the transformed region and other regions of the computer graphics illustration, which are not combined to form the transformed region. For example, a storage device, which is a computer-readable medium, can be operatively coupled to the computer, and the transformed region and the other regions can be stored in the storage device. Further, after dividing the computer graphics illustration into atomic regions, if the process 300 determines that at least one of the overlapping image object or the overlapped image object is resolution dependent, e.g., a raster image object, then the process 300 can store the atomic regions in the storage device. Furthermore, if the process 300 determines that the overlapping image object is not transparent, then the process 300 can store the atomic regions in the storage device. In some implementations, the storing 330 can include transmitting the transformed region and other regions of the computer graphics illustration. In such implementations, although the regions need not be immediately recorded in a computer-readable medium, the regions are transmitted, e.g., to a raster image processor, where they can be stored in a computer-readable medium, at least temporarily.

In this manner, the computer can selectively transform regions of image objects in a computer graphics illustration where the image objects satisfy certain criteria related to resolution dependence and transparency. By storing the selectively transformed regions, the computer creates a partially processed computer graphics illustration which can be provided to a processing device, e.g., a raster image processor, for further processing.

Figure 4:
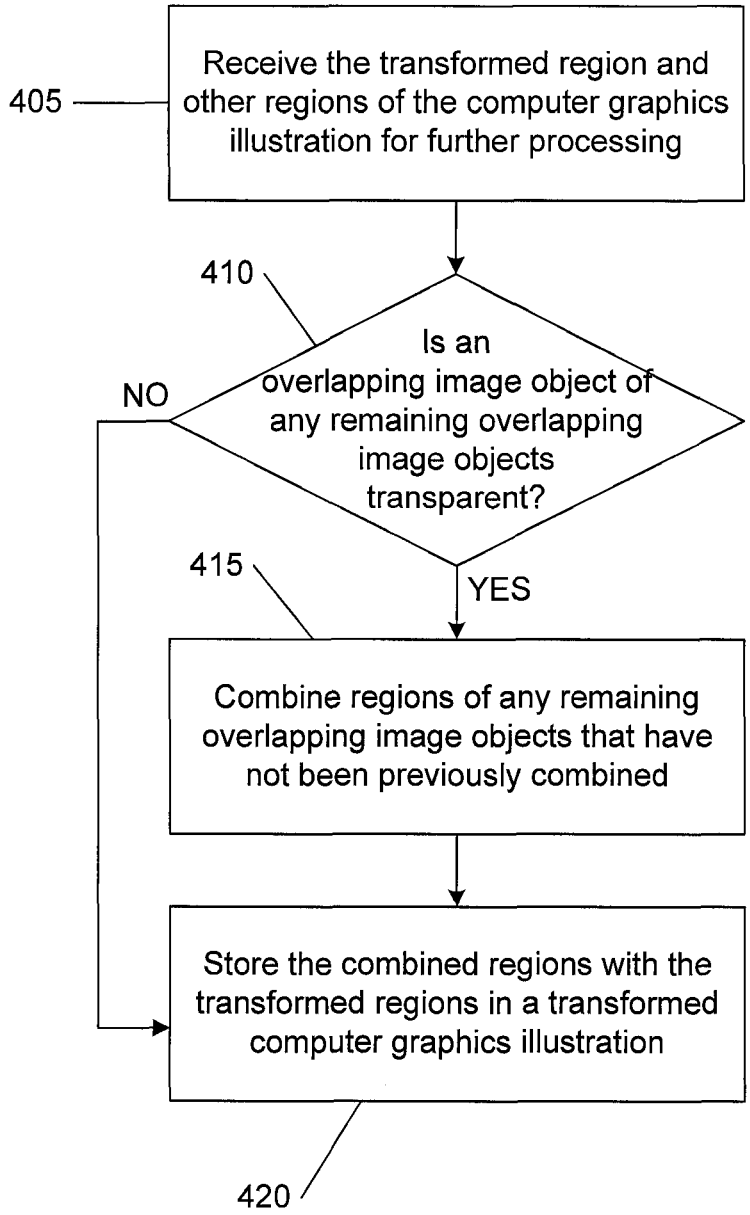
FIG. 4 is an example process 400 for transforming a transformed region and other regions of the computer graphics illustration.

FIG. 4 is an example process 400 to transform the transformed region and other regions of the computer graphics illustration. The process 400 can receive 405 the transformed region and other regions of the computer graphics illustration for further processing. For example, the raster image processor can receive the multiple atomic regions of the partially processed computer graphics illustration that includes the transformed region, one or more regions associated with one or image objects that are not overlapped by another image object, and one or more regions associated with one or more image objects that are overlapped by another image object, and at least one of the overlapping or overlapped image objects is resolution dependent.

The process 400 can check 410 if the overlapping image object of any remaining overlapping image objects is transparent. For example, the raster image processor can determine if the overlapping image object is transparent.

If the overlapping image object is transparent, the process 400 can combine 415 regions of any remaining overlapping image objects that have not been previously combined. For example, the raster image processor can take the overlapping image object and the overlapped image object, and combine, e.g., blend, them in accordance with a specified blend function to generate the transformed region.

While a transformed region formed by the computer is formed from regions included in resolution independent image objects, a transformed region formed by the raster image processor is formed from at least one region included in at least one resolution dependent image object. The computer and the raster image processor transform the regions only when the overlapping image object is transparent. If the overlapping image object is non-transparent, then transforming need not be performed.

The process 400 can store 420 the combined regions with the transformed regions in a revised computer graphics illustration. For example, in some implementations, the raster image processor can store the revised computer graphics illustration. In other implementations, the raster image processor can transmit the revised computer graphics illustration to an output device, e.g., a printer, for printing. In other implementations, the raster image processor can transmit the revised computer graphics illustration to the computer, e.g., via one or more networks, and provide the revised computer graphics illustration to the user.

Implementations of the subject matter and the functional operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer program products, i.e., one or more modules of computer program instructions encoded on a computer-readable medium for execution by, or to control the operation of, data processing apparatus. The computer-readable medium can be a machine-readable storage device, a machine-readable storage substrate, a memory device, or a combination of one or more of them. The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them.

A computer program (also known as a program, software, software application, script, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer-readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described is this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

While this specification contains many specifics, these should not be construed as limitations on the scope of the disclosure or of what may be claimed, but rather as descriptions of features specific to particular implementations of the disclosure. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations have been described. Other implementations are within the scope of the following claims. When the overlapping image object is non-transparent, then the regions of the overlapping region are not combined, e.g., blended. In some implementations, the computer can be a server in a network, e.g., the Internet, to which several remote processors are operatively coupled. A user can create computer graphics illustrations, selectively transform regions of the created illustrations, and transmit the partially processed illustrations to one or more remote processors. The remote processors can be connected to an output device, e.g., a printer. The remote processors can create the revised computer graphics illustration and transmit the revised illustration to the printer for printing. Alternatively, or in addition, the remote processors can transmit the revised illustration to the computer over the Internet.

In some implementations, the remote processor can be a node to which multiple computers are operatively coupled over one or more networks, e.g., the Internet. Each computer can include a corresponding display device and input devices using which a user can create one or more computer graphics illustrations including overlapping image objects. The computer can selectively transform regions of the computer graphics illustration and transmit the selectively transformed regions and other regions of the illustration over the Internet to the remote processor. The remote processor can further process the illustration to form a revised computer graphics illustration. The remote processor can transmit the revised illustration to a printer for printing and/or can transmit the revised illustration to the computer wherefrom the partially processed illustration was received.

In some implementations, the software application installed on the computer can provide the user with an option to choose the amount of transforming of the computer graphics illustration. For example, the user interface in the display device can include an option, e.g., in a menu, as an icon, and the like. When the user instructions the computer to commence transforming regions in the illustration, the computer presents the option to the user. The option allows the user to select if the user wishes to transform regions of the illustration selectively or completely. If the user chooses to selectively transform regions, then the computer can selectively transform overlapping region formed by resolution independent image objects and the remote processor can transform any other overlapping regions. If the user chooses to completely transform regions, then the computer can transmit the computer graphics illustration to the remote processor. In such instances, the computer can divide the overlapping image objects into atomic regions before transmitting the illustration to the remote processor. In other instances, all operations related to processing the illustration can be performed by the remote processor.

What is claimed is:

1. A computer-implemented method comprising:

receiving a computer graphics illustration including multiple image objects comprising a resolution dependent image object and a resolution independent image object, the computer graphics illustration stored in a computer-readable medium;

identifying, in the computer graphics illustration, an overlapping region formed by a region of an overlapping image object having transparency positioned over a region of an overlapped image object, wherein the overlapping image object and the overlapped image object are resolution independent image objects;

combining the region of the overlapping image object and the region of the overlapped image object to form a transformed region that is resolution independent;

storing the transformed region and the other regions of the computer graphics illustration, which other regions are not combined to form the transformed region to provide for further processing;

receiving the transformed regions and other regions of the computer graphics illustration; and combining regions of any remaining overlapping image objects that have not been previously combined to form corresponding transformed regions upon determining that an overlapping object of the any remaining overlapping image objects has transparency;

wherein combining the region of the overlapping image object and the region of the overlapped image object to form a transformed region that is resolution independent is performed at a host location, and combining regions of any remaining overlapping image objects that have not been previously combined to form corresponding transformed regions is performed at a remote location.

2. The method of claim 1, wherein the storing comprises transmitting the transformed region and the other regions of the computer graphics illustration to a computer-readable medium to provide for further processing.

3. The method of claim 1, further comprising combining regions of any remaining overlapping image objects that have not been previously combined to form corresponding transformed regions at a raster image processor operatively coupled to the remote location.

4. The method of claim 1, further comprising operatively coupling the host location to the remote location via one or more networks.

5. The method of claim 1, further comprising displaying the computer graphics illustration in a display device.

6. The method of claim 1, further comprising:

displaying a selectable option to combine the region of the overlapping image object and the region of the overlapped image object to form the transformed region that is resolution independent; and in response to detecting a selection of the selectable option, forming the transformed region at a host location.

7. A non-transitory computer-readable storage medium, comprising instructions that when executed by a data processing apparatus, cause the data processing apparatus to perform operations comprising:

receiving a computer graphics illustration including multiple image objects comprising a resolution dependent image object and a resolution independent image object, the computer graphics illustration stored in a computer-readable medium;

identifying, in the computer graphics illustration, an overlapping region formed by a region of an overlapping image object having transparency positioned over a region of an overlapped image object, wherein the overlapping image object and the overlapped image object are resolution independent image objects;

combining the region of the overlapping image object and the region of the overlapped image object to form a transformed region that is resolution independent; and storing the transformed region and the other regions of the computer graphics illustration, which other regions are not combined to form the transformed region to provide for further processing;

receiving the transformed regions and other regions of the computer graphics illustration; and combining regions of any remaining overlapping image objects that have not been previously combined to form corresponding transformed regions upon determining that an overlapping object of the any remaining overlapping image objects has transparency;

wherein combining the region of the overlapping image object and the region of the overlapped image object to form a transformed region that is resolution independent is performed at a host location, and combining regions of any remaining overlapping image objects that have not been previously combined to form corresponding transformed regions is performed at a remote location.

8. The non-transitory computer-readable storage medium of claim 7, wherein the storing comprises transmitting the transformed region and the other regions of the computer graphics illustration to a computer-readable medium to provide for further processing.

9. The non-transitory computer-readable storage medium of claim 7, the operations further comprising combining regions of any remaining overlapping image objects that have not been previously combined to form corresponding transformed regions at a raster image processor operatively coupled to the remote location.

10. The non-transitory computer-readable storage medium of claim 7, the operations further comprising operatively coupling the host location to the remote location via one or more networks.

11. The non-transitory computer-readable storage medium of claim 7, the operations further comprising displaying the computer graphics illustration in a display device.

12. The non-transitory computer-readable storage medium of claim 7, the operations further comprising:

displaying a selectable option to combine the region of the overlapping image object and the region of the overlapped image object to form the transformed region that is resolution independent; and in response to detecting a selection of the selectable option, forming the transformed region at a host location.

13. A system comprising:

a processor; and a computer program product encoded on a computer-readable medium, the computer program product configured to cause the processor to perform operations comprising:

receiving a computer graphics illustration including multiple image objects comprising a resolution dependent image object and a resolution independent image object, the computer graphics illustration stored in a computer-readable medium;

identifying, in the computer graphics illustration, an overlapping region formed by a region of an overlapping image object having transparency positioned over a region of an overlapped image object, wherein the overlapping image object and the overlapped image object are resolution independent image objects;

combining the region of the overlapping image object and the region of the overlapped image object to form a transformed region that is resolution independent; and storing the transformed region and the other regions of the computer graphics illustration, which other regions are not combined to form the transformed region to provide for further processing;

receiving the transformed regions and other regions of the computer graphics illustration; and combining regions of any remaining overlapping image objects that have not been previously combined to form corresponding transformed regions upon determining that an overlapping object of the any remaining overlapping image objects has transparency;

wherein combining the region of the overlapping image object and the region of the overlapped image object to form a transformed region that is resolution independent is performed at a host location, and combining regions of any remaining overlapping image objects that have not been previously combined to form corresponding transformed regions is performed at a remote location.

14. The system of claim 13, wherein the storing comprises transmitting the transformed region and the other regions of the computer graphics illustration to a computer-readable medium to provide for further processing.

15. The system of claim 13, the operations further comprising combining regions of any remaining overlapping image objects that have not been previously combined to form corresponding transformed regions at a raster image processor operatively coupled to the remote location.

16. The system of claim 13, the operations further comprising operatively coupling the host location to the remote location via one or more networks.

17. The system of claim 13, the operations further comprising displaying the computer graphics illustration in a display device.

18. The system of claim 13, the operations further comprising:

displaying a selectable option to combine the region of the overlapping image object and the region of the overlapped image object to form the transformed region that is resolution independent; and in response to detecting a selection of the selectable option, forming the transformed region at a host location.

* * * * *